United States Patent [19]

Kohler

[11] 4,250,432

[45] Feb. 10, 1981

[54] TOUCH DIMMER CIRCUIT

[75] Inventor: Thomas P. Kohler, Baldwinsville, N.Y.

[73] Assignee: Beatrice Foods Co., Chicago, Ill.

[21] Appl. No.: 30,465

[22] Filed: Apr. 16, 1979

[51] Int. Cl.[3] ..... H05B 37/02

[52] U.S. Cl. ..... 315/291; 307/116; 307/308; 315/199; 315/362

[58] Field of Search ..... 315/194, 199, 291, 362; 307/116, 308; 200/DIG. 1, DIG. 2; 328/5; 361/179, 181

[56] References Cited

U.S. PATENT DOCUMENTS

| | | | |
|---|---|---|---|
| 3,862,432 | 1/1975 | Larson | 307/116 |
| 4,023,052 | 5/1977 | Kroner | 307/308 |
| 4,053,789 | 10/1977 | Schultz | 328/5 X |

FOREIGN PATENT DOCUMENTS

| | | | |
|---|---|---|---|
| 2363069 | 3/1975 | Fed. Rep. of Germany | 307/308 |

OTHER PUBLICATIONS

*Digital MOS—Sensor—Dimmer with IC S 566 B*, Siemens application note MSR/p—7707/19, 11/1977 (315-291).

*Primary Examiner*—Eugene R. La Roche
*Attorney, Agent, or Firm*—Hill, Van Santen, Steadman, Chiara & Simpson

[57] ABSTRACT

A touch dimmer switch incorporating an integrated circuit for controlling a thyristor dimming circuit, has a touch control connected in a high impedance, unidirectionally conducting circuit, and a filter circuit for filtering out ambient electrical noise. The touch control is isolated from the AC power source so that the polarity of connection to the power source is not critical.

10 Claims, 1 Drawing Figure

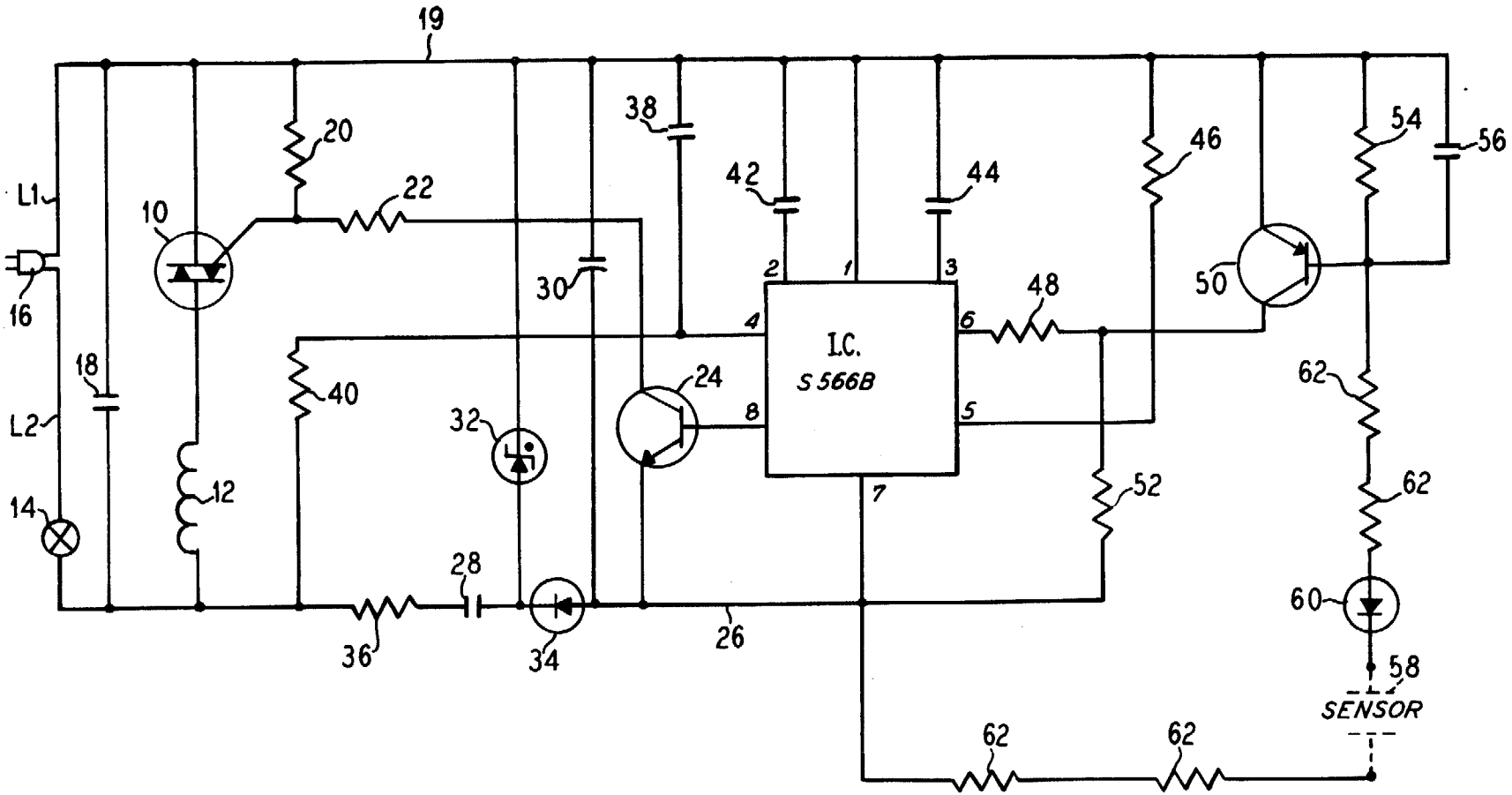
I.C.
S566B
SENSOR
L1
L2

TOUCH DIMMER CIRCUIT

BACKGROUND

1. Field of the Invention

The present invention relates to dimmer control circuits, and more particularly to such circuits having touch sensitive controls.

2. The Prior Art

Control circuits for thyristor type lamp dimmers are in common use, and many of them energize a triac or other thyristor by means of signals developed from an integrated circuit. One such integrated circuit (or IC) is Model No. S566B, which is commercially available from the Siemens Corporation, and incorporates an MOS circuit for controlling a triac dimmer circuit. The DC power for operating the integrated circuit is derived from the line voltage, which is coupled to a load by the triac. The integrated circuit Model S566B may be controlled with two different types of touch control circuits. In one type of control circuit, a touch sensor is connected by high impedance to one input of the IC. Because of the high impedance of the circuit, the touch sensor must be located quite close to the IC, in order to avoid faulty operation due to transient noise. The other type of control circuit incorporates a transistor having its emitter and collector terminals connected in series between one side of the AC power line and another input of the IC, with a touch sensor connected between the base of such transistor and ground. Since the emitter and collector terminals of the transistor constitute a low impedance circuit, the transistor and touch sensor may be located remotely from the IC, without adverse effects. However, the touch sensor must remain located relatively close to the transistor, because of the high impedance touch sensor circuit. It is, therefore, not possible in either version of control circuit to have the touch sensor located remotely from all of the other equipment, without being subject to transient electrical noise.

Another disadvantage of the previously known touch control circuit arrangements is that proper operation of the control circuit depends upon a specific polarity of the line circuit, and if the line plug is inserted incorrectly into its receptacle, the control circuit does not function.

BRIEF DESCRIPTION OF THE INVENTION

It is a principal object of the present invention to provide a touch control circuit for a dimmer control in which the touch sensor may be remotely located from the other components of the circuit.

Another object of the present invention is to provide a touch control circuit which is not sensitive to the polarity of the connection with the line power.

In one embodiment of the present invention, the Model No. S566B IC is employed with an operating transistor interconnected between a source of DC potential and one input terminal of the IC. A touch sensor is interconnected in a unidirectional conducting circuit between a control terminal of the transistor and a reference DC potential, and a filter is connected in circuit with said transistor for filtering out high frequency signals.

In such an arragement, even though the touch sensor is in a high impedance circuit, it is relatively immune from AC noise, and may be located remotely from the other components.

These and other objects and advantages of the present invention will become manifest by inspection of the accompanying drawing and the following description.

BRIEF DESCRIPTION OF THE DRAWING

Reference will now be made to the accompanying drawing, which is a schematic diagram of a preferred embodiment of the present invention.

DESCRIPTION OF THE PREFERRED EMBODIMENT

Referring now to the drawing, the dimmer circuit incorporates a triac 10, connected in series with an inductance 12 and a load 14. A line plug 16 is adapted to be plugged into a conventional power line receptacle, so that line voltage via L1 and L2 is impressed across the load 14 when the triac 10 conducts. The power line may be 120 V 60 Hz. or any other available voltage and AC frequency. A capacitor 18 is connected in parallel across the triac 10 and the inductance 12, to form, with the inductance 12, a noise suppressing circuit.

The gate of the triac 10 is connected to L1 by means of a resistor 20 and line 19, and is connected by resistor 22 to the collector of the transistor 24, the base of which is connected to the pin 8 of the S566B. The emitter of the transistor 24 is connected to a line 26 which is at a reference DC potential as described hereinafter.

In operation, the S566B controls conduction of the transistor 24, which in turn fires the triac 10 at a selected time within a range of 30° to 150° of each half cycle of the line power. The triac 10 thereafter remains fired to the end of the half cycle.

DC power for the S566B is derived from circuit incorporating capacitors 28 and 30 and diodes 32 and 34 which are connected as a voltage doubler circuit. The diode 32 is a 15 volt zener diode, which maintains the voltage across the storage capacitor 30 at about 15 volts DC. A resistor 36 is connected in series with the capacitor 28 to limit surge current.

The DC potential across the storage capacitor 30 is connected between pins 1 and 7 of the S566B, via lines 19 and 26. It will be appreciated that the potential on line 26 is a DC reference potential which is isolated from the AC line power by the capacitors 28 and 30 and the diodes 32 and 34.

The operation of the S566B is synchronized by means of a signal derived from a series connected circuit including capacitor 38 and resistor 40 connected across the triac 10 and the inductance 12. The junction of the capacitor 38 and the resistor 40 is connected to pin 4 of the IC. Pins 2 and 3 of the IC are connected to line 19, by way of capacitors 42 and 44 respectively, which is a conventional connection for the S566B.

Pin 5 of the S566B, which is the normal sensor input, is connected to the line 19 by a pull-up resistor 46. The inverting input at pin 6 is connected by a resistor 48 to the collector of a pnp operating transistor 50, the emitter of which is connected to the line 19. The collector of the transistor 50 is also connected to the reference potential of line 26 by a resistor 52.

A parallel circuit incorporating a resistor 54 and a capacitor 56 are connected between line 19 and the base of the transistor 50, and a series circuit incorporating a touch sensor unit 58 is connected between the base of the transistor 50 and the reference potential on line 26. Such series circuit includes a diode 60 and a plurality of resistors 62 on both sides of the sensor unit 58. The resistors 62 are of sufficiently high value to give absolute protection from electrical shock to a person touching the sensor unit 58. Preferably, each of the resistors 62 are 2.2 megohms, the resistor 54 is 4.7 megohms and the capacitor 56 is 0.1 microfarads.

In operation, the operating transistor 50 is normally cut off, and the capacitor 56 functions as a short circuit for high frequency signals which may be picked up by the high impedance circuit including the sensor 58. The diode 60 prevents any conduction of AC current in this circuit, and since it is connected in the DC power circuit only between lines 19 and 26, it is isolated from the AC line power. Normally, all of the DC voltage drop is across the sensor unit 58, and since there is no DC voltage drop across the resistor 54, the transistor 50 remains cut off.

When it is desired to operate the S566B, an operator places his hand or finger in the vicinity of the sensor unit 58, bridging its two terminals, and base current flows through the diode 60. This biases the transistor 50 into conduction, raising the potential at pin 6 of the S566B and causing it to operate. If the operator's hand remains on the sensor 58 for a period of 0.06 seconds to 0.4 seconds, the S566B is switched on if previously off, and switched off if previously on. If the operator's hand remains there longer, the IC causes an increase in the phase angle of firing the triac 10 from minimum to maximum, and then back to the minimum with a reversal time of about 3½ seconds. As soon as the operator removes his hand from the vicinity of the sensor unit 58, the transistor 50 is cut off, the change in the phase angle stops, and the phase angle is held constant in a memory of the IC. In a subsequent dimming operation, the direction of change of the phase angle is reversed by circuitry within the IC.

Alternatively, the sensor 58 may be of a capacitive type, in which the proximity of an operator's hand, without electrical contact, modifies the capacitance of the sensor. The time constant of the sensor circuit is sufficiently long as to keep the transistor 50 conducting for at least a sufficient time to allow a change from minimum to maximum phase angle, or vice versa. If desired, an auxiliary capacitor (not shown) may be connected in parallel with the sensor unit 58, to trim the time constant. When the operator's hand is removed, the charge on the capacitor 56 is dissipated through the resistor 54 and the charge between the terminals of the sensor 58 is dissipated by leakage, so that the operation may be repeated subsequently in the same way as described above.

By use of the present invention, the polarity of the plug 16 is irrelevant, because operation is identical, irrespective of the relative polarity of lines L1 and L2. This is because the DC potential of the sensor circuit is isolated from the AC line.

The circuit of the present invention is not limited to the position of the sensor unit 58, even though the sensor circuit is a high impedance circuit, because the presence of the diode 60 and the filter incorporating the capacitor 56 provide superior immunity from transient noise signals, including the common 60 Hz. noise by restricting response of the circuit to a DC control signal.

It is apparent that various additions and modifications may be made in the apparatus of the present invention without departing from the essential features of novelty thereof, which are intended to be defined and secured by the appended claims. For example, discrete components or a different IC may be used, and the remote sensor may be used in applications other than dimmer controls.

What is claimed is:

1. A touch sensitive dimmer control circuit incorporating a circuit means for controlling the phase of conduction of a thyristor interconnected in series with a load and a source of AC power, comprising in combination, a source of DC potential for powering said circuit means, an operating transistor having two terminals interconnected between a source of DC potential and an input terminal of said circuit means, bias means for maintaining said operating transistor in a first non-oscillating conducting state, a touch sensor, and a connecting circuit including said sensor for interconnecting a control terminal of said transistor with a DC reference potential electrically isolated from said AC power source, whereby operation of said touch sensor causes said operating transistor to assume a second non-oscillating conducting state.

2. Apparatus according to claim 1, including a diode connected in series with said touch sensor.

3. Apparatus according to claim 1, including a low pass filter connected with said operating transistor for filtering out AC signals induced in said connecting circuit.

4. Apparatus according to claim 1, wherein said touch sensor is a two terminal device and wherein said connecting means includes first high impedance connecting means for connecting one terminal of said touch sensor to said DC potential and second high impedance means connecting one terminal of said touch sensor to said reference potential.

5. Apparatus according to claim 4, wherein said touch sensor incorporates two spaced-apart conductors exposed to being touched by an operator's hand.

6. A touch sensitive dimmer control incorporating means for controlling the phase of conduction of a thyristor connected in series with the load and a source of AC power comprising in combination an operating transistor having two terminals connected between a source of operating voltage and an input terminal of said controlling means, bias means for maintaining said operating transistor in a non-oscillating conducting state, a touch sensor located remotely from said operating transistor and connected thereto by a high impedance connecting circuit, and a filter connected to said operating transistor for filtering out AC signals induced in said connecting circuit.

7. Apparatus according to claim 6, wherein said operating voltage is a DC voltage, and including means interconnecting said touch sensor with said DC voltage and means including a diode and a capacitor separating one side of said DC voltage from said AC power source.

8. Apparatus according to claim 6, including a diode in said connecting circuit.

9. A touch sensitive dimmer control incorporating means for controlling the phase of conduction of a thyristor connected in series with a load and a source of AC power, comprising in combination, an operating transistor having two terminals connected between a source of operating voltage and an input to said controlling means, bias means for maintaining said operating transistor in a non-oscillating state, and a touch sensor located remotely from said operating transistor and connected thereto by a high impedance connecting circuit, said high impedance circuit incorporating a series connected diode for permitting only unidirectional current flow through said circuit.

10. Apparatus according to claim 9, including a filter connected to said operating transistor for filtering out AC signals induced in said connecting circuit.

* * * * *